US006860818B2

(12) United States Patent
Mahaffey et al.

(10) Patent No.: US 6,860,818 B2
(45) Date of Patent: Mar. 1, 2005

(54) GOLF CLUB HEAD WITH PERIPHERAL WEIGHTING

(75) Inventors: Steven J. Mahaffey, Belchertown, MA (US); Thomas M. Greene, Monson, MA (US); David Lowe, Unionville, CT (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/379,146

(22) Filed: Mar. 4, 2003

(65) Prior Publication Data

US 2003/0232659 A1 Dec. 18, 2003

Related U.S. Application Data

(60) Provisional application No. 60/389,347, filed on Jun. 17, 2002.

(51) Int. Cl.[7] ..... A63B 53/04
(52) U.S. Cl. ..... 473/256; 473/327
(58) Field of Search ..... 473/334, 335, 473/336, 337, 338, 339, 341, 345, 349

(56) References Cited

U.S. PATENT DOCUMENTS 4,085,934 A * 4/1978 Churchward ..... 473/338
D275,412 S * 9/1984 Simmons ..... D21/752
4,869,507 A * 9/1989 Sahm ..... 473/337
4,944,515 A * 7/1990 Shearer ..... 473/337
5,203,565 A * 4/1993 Murray et al. ..... 473/242
5,207,428 A 5/1993 Aizawa
5,518,243 A * 5/1996 Redman ..... 473/334
5,613,917 A 3/1997 Kobayashi et al.
5,676,606 A 10/1997 Schaeffer et al.
5,720,674 A 2/1998 Galy
5,785,609 A * 7/1998 Sheets et al. ..... 473/327
5,803,830 A * 9/1998 Austin et al. ..... 473/328
5,967,905 A * 10/1999 Nakahara et al. ..... 473/345
5,971,867 A 10/1999 Galy
5,989,134 A * 11/1999 Antonious ..... 473/327
6,206,790 B1 * 3/2001 Kubica et al. ..... 473/335
6,217,461 B1 4/2001 Galy
6,458,044 B1 10/2002 Vincent et al.
6,527,650 B2 * 3/2003 Reyes et al. ..... 473/345

* cited by examiner

*Primary Examiner*—Gregory Vidovich
*Assistant Examiner*—Nini F. Legesse
(74) *Attorney, Agent, or Firm*—Lawrence E. Laubacher; Michael A. Catania; Elaine H. Lo

(57) ABSTRACT

A golf club head with low peripheral and rearward weighting includes C-shaped and annular weights connected with at least one of the rear and bottom surfaces, respectively, of the head. The weighting within the peripheral weights is adjustable between the heel, rear, and toe portions of the head to customize the weight distribution of the head in accordance with a golfer's swing. The added weight and its orientation increases the moment of inertia of the head and reduces the rotation thereof.

7 Claims, 3 Drawing Sheets

GOLF CLUB HEAD WITH PERIPHERAL WEIGHTING

This application claims the benefit of U.S. provisional application No. 60/389,347 filed Jun. 17, 2002.

BACKGROUND OF THE INVENTION

The boon of the amateur golfer is mis-hit shots resulting from striking a golf ball outside of the central area or sweet spot of the club face. In order to compensate for such shots, golf clubs have been developed which include perimeter weighting. That is, weight in the club head is re-distributed around the perimeter of the striking face in order to enlarge the sweet spot of the face.

While perimeter weighting is particularly useful in iron-type golf club heads, wood heads present additional difficulties to the amateur golfer because of the enlarged body behind the striking face. Such heads generally produce a lower trajectory and more side spin on a ball, both of which decrease the length and accuracy of the shot.

The present invention relates to an improved wood-type golf club head with adjustable weighting around the rear periphery of the head and increased weighting toward the sole of the club. Low rearward weighting increases the launch angle and reduces the spin rate of a struck golf ball. Peripheral weighting generally increases the moment of inertia and the resistance to rotation of the club head.

BRIEF DESCRIPTION OF THE PRIOR ART

Peripheral weights for golf club irons are known in the patented prior art as evidenced by the U.S. patent to Kobayashi et al. U.S. Pat. No. 5,613,917. Similarly, peripheral weights for putters are known as shown by the Schaeffer et al. U.S. Pat. No. 5,676,606. Lastly, peripheral weights for woods are shown in the U.S. patents to Galy U.S. Pat. No. 5,720,674, Aizawa U.S. Pat. No. 5,207,428, Galy U.S. Pat. No. 5,971,867, and Galy U.S. Pat. No. 6,217,461.

While the prior devices operate satisfactorily, most of the peripherally weighted woods are limited by the fact that the weight distribution cannot be altered to customize the club to the needs of a particular golfer. The present invention was developed in order to overcome these and other drawbacks of the prior clubs by providing a wood-type golf club head with adjustable peripheral weighting and low rearward weighting to improve the performance of the club.

SUMMARY OF THE INVENTION

Accordingly, the present invention relates to a golf club head of the wood-type having a metal body with upper and lower surfaces, a ball striking face, a curved rear surface, and toe and heel surfaces between the striking face and the rear surface. A peripheral weight is connected with the body on at least one of the rear and lower surfaces in order to increase the moment of inertia of the club head.

According to a preferred embodiment, the rear surface of the club head contains an elongated recess within which a C-shaped peripheral weight is removably connected. The peripheral weight is preferably formed of a synthetic plastic housing within which weight members are arranged. The weight members can be integrally molded into the housing at specific locations along the length of the housing to provide a variable weight distribution. When the housing is connected with the club head, the weight member provides more weight in the head at the specific location which may be arranged more toward the toe, rear, or heel of the club head.

Alternatively, the housing contains a plurality of chambers adapted to receive the weight members. The chambers are arranged along the length of the housing so that the weight members can be placed in the desired chamber by the golfer prior to connecting the housing to the club head so that once assembled, the selected weight distribution is provided in the club head.

In another embodiment, the peripheral weight has an annular configuration and is connected within an annular slot in the bottom surface of the head. Additional weight can be provided at the rear and extending upwardly toward the upper surface. Moreover, the weight distribution in the annular weight can be tailored to provide more weight toward the toe, heel, or rear of the club head.

BRIEF DESCRIPTION OF THE FIGURES

Other objects and advantages of the invention will become apparent from a study of the following specification when viewed in light of the accompanying drawing, in which.

DETAILED DESCRIPTION

Figure 1:
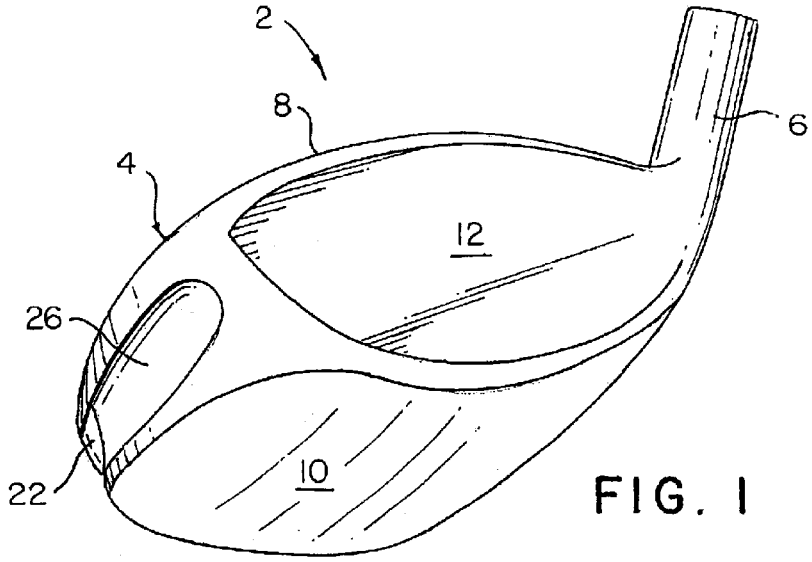
FIG. 1 is a perspective view of the wood-type golf club head according to a first embodiment.
Figure 2:
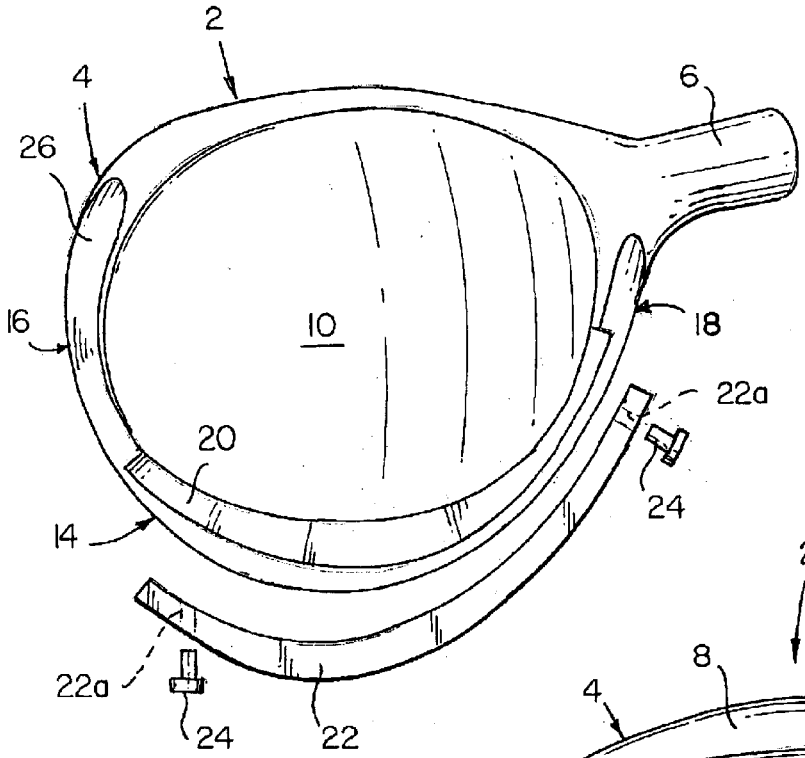
FIGS. 2 and 3 are exploded bottom and end views, respectively, of the club head of FIG. 1.
Figure 3:
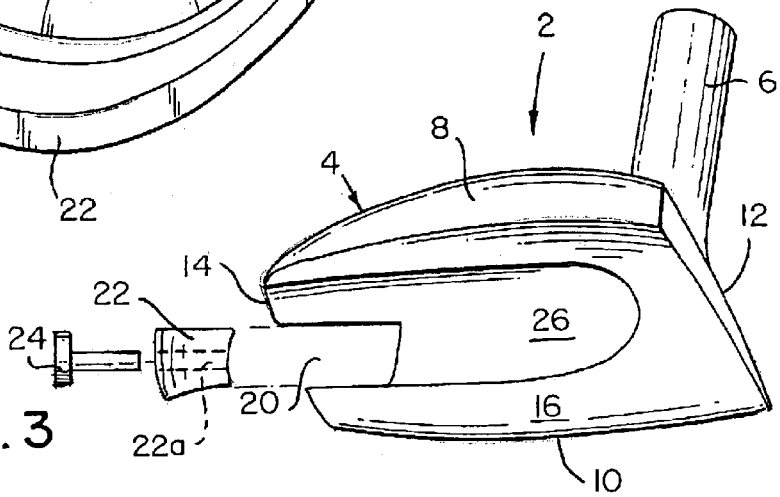

FIGS. 1–3 show the preferred embodiment of the golf club head with a peripheral weight according to the invention. The club head 2 is of the wood type, and is preferably a metal wood including a body 4 and hosel 6. The body includes an upper surface 8, a lower surface 10 which defines the sole of the club, a ball striking face 12 and a curved rear surface 14. Between the striking face 12 and the rear surface 14 are a toe surface 16 and a heel surface 18. The head is formed in a conventional manner, preferably by welding components together as is known in the art.

The rear surface 14 contains an elongated recess 20 which extends between the toe and heel surfaces as best shown in FIG. 2. The slot is adapted to receive a C-shaped peripheral weight 22. Preferably, the weight 22 is removably connected with the body 4 by suitable fasteners such as screws 24 which pass through openings 22*a* in the weight and into aligned threaded openings (not shown) in the body. Alternatively, the weight 22 can be permanently secured within the recess by welding, adhesive, or the like.

The weight 22 can have a uniform weight distribution or it can have a variable distribution so that when it is connected with the head, more weight can be provided in a particular region of the head, either rearwardly or more toward the toe or heel portion as desired. For permanent installations, the weight can be formed of any material such as metal or fiber reinforced plastic.

The golf club head further includes a concave slot 26 which extends from the toe to the heel area of the club head. The slot extends beyond the recess and the recess is contained within the slot as shown in FIGS. 2 and 3. The slot improves the aerodynamic properties of the club head because it reduces air resistance during a golf swing. The slot results in a larger striking face area relative to the overall frontal area of the head without reducing the size of the sole.

Figure 4A:
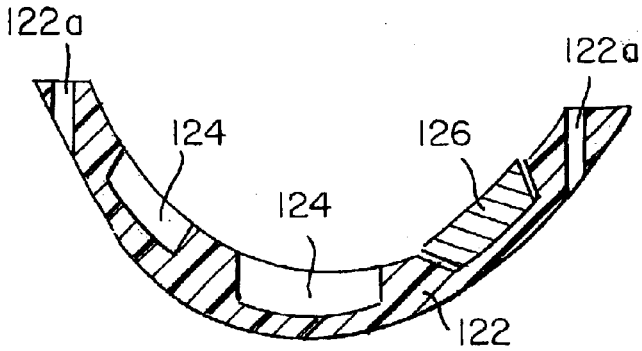
FIGS. 4A and 4B are cross-sectional views of a peripheral weight for the club head of FIG. 1.
Figure 4B:
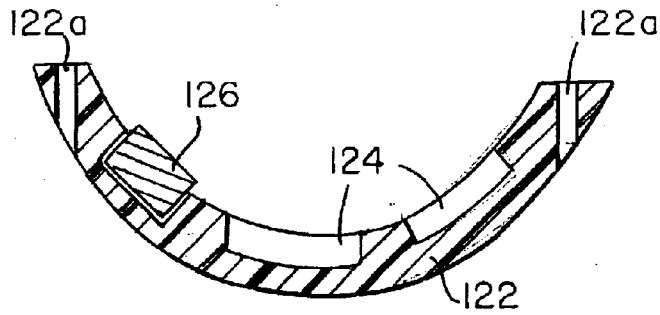

In FIGS. 4A and 4B, there is shown a preferred C-shaped peripheral weight. The weight comprises a housing 122 preferably formed of synthetic plastic material which contains a plurality of chambers 124 in the inner concave surface thereof. Each chamber is designed to receive a weight member 126. As with the weight 22 in the embodiment of FIGS. 1–3, the housing includes through openings 122*a* for receiving screws (not shown) for removably connecting the housing 122 with a club head.

When the housing 122 is disconnected from the club head, the golfer may position the weight member 126 in a selected chamber to provide more weight in a selected area of a club head. For example, when the weight is positioned in the chamber as shown in FIG. 4A and the housing is connected with a head oriented as shown in FIG. 2, more weight will be provided rearwardly and toward the heel end of the club head. If the weight is positioned as shown in FIG. 4B, more weight will be provided rearwardly and toward the toe end of the club head.

Although only a single weight member is shown in the drawing, weight members can be positioned in more than one chamber as desired. The weight members can be arranged as part of a package with different weighting for the members to enable a golfer to customize the weight distribution in the head.

Figure 5:
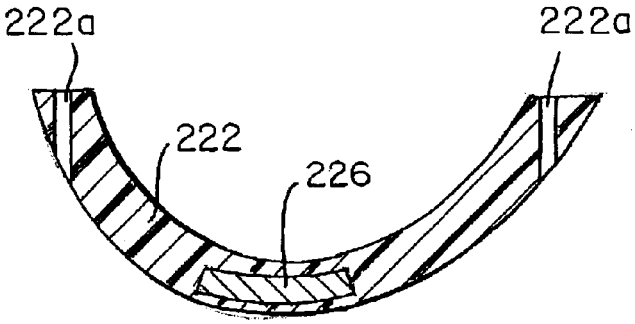
FIG. 5 is a cross-sectional view of an alternate peripheral weight for the club head of FIG. 1.

FIG. 5 illustrates a further embodiment for a C-shaped peripheral weight having a synthetic plastic housing 222 including through openings 222*a* for connecting the weights with a club head in the same manner as discussed above. In this embodiment, a weight member 226 is molded within the housing 222 in a desired location. The weight can be part of a package with weight members molded in different locations so that different peripheral weights with different weight distributions can be connected with the club head to customize the weight distribution in the head.

Figure 6:
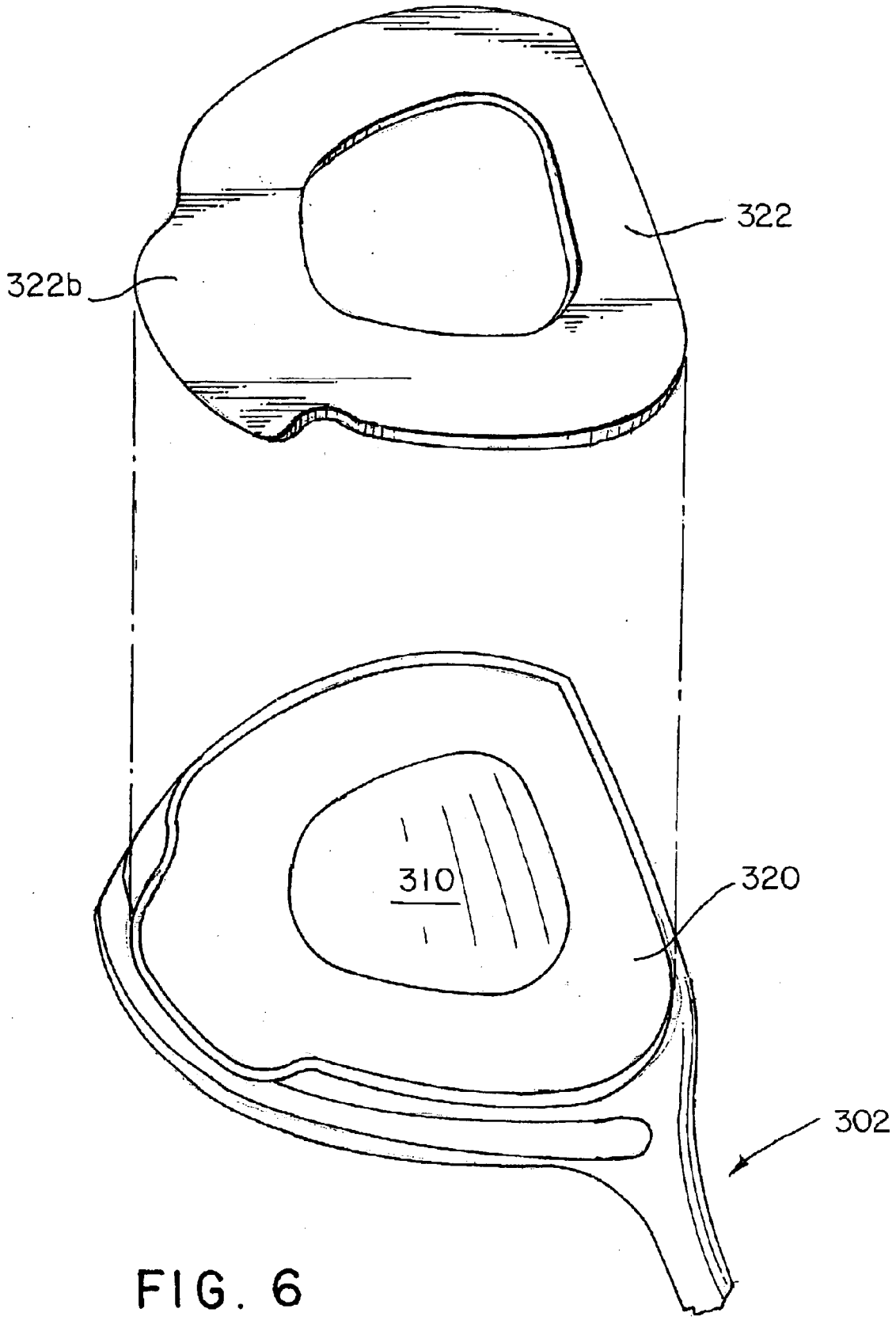
FIG. 6 is an exploded bottom perspective view of a wood-type golf club head according to a second embodiment of the invention.

FIG. 6 shows a club head 302 with a peripheral weight 322 which is connected with the lower surface or sole 310 of the head. The sole contains an annular recess 320 for receiving the weight 322 which also has an annular configuration. Unlike the weight 22 in the first embodiment of FIGS. 1–3 which provides weight around the rear portion of the head, the annular weight 322 provides weight around the bottom circumference of the head. Increased weight at the bottom of the head provides a higher trajectory to a ball struck by the club. Peripheral weighting increases the moment of inertia and the resistance to rotation of the club, particularly when a ball is struck outside the center of the striking face.

In order to provide more weight toward the rear of the club, the annular weight 322 includes a portion 322*b* which extends upwardly over the rear surface of the club to reduce the spin rate of a golf ball struck by the club.

The weight 322 is secured within the club head recess 320 by welding or by an adhesive. For a removable connection, the weight can be screwed onto the club head in a known manner.

The annular weight 322 can be provided with a uniform weight distribution or with a variable weight distribution depending upon the desired weighting of the head. Thus, differently weighted annular weights can be substituted on the head to satisfy a golfer's preference. The annular weight can be formed of metal, synthetic plastic, fiber reinforced synthetic plastic or other suitable materials.

The head 302 may also be provided with an elongated concave slot 326 extending between the heel and the toe portions to increase the aerodynamic properties of the head.

It will be appreciated by those of ordinary skill in the art that a club head can also be provided which includes both the rearward C-shaped peripheral weight 22 of FIGS. 1–3 and the annular peripheral weight 322 of FIG. 6. Any combination or orientation of peripheral weighting can be achieved to satisfy the desires of the golfer to match the club head with the golfer's swing.

While the preferred forms and embodiments of the invention have been illustrated and described, it will be apparent to those of ordinary skill in the art, that various changes and modifications may be made without deviating from the inventive concepts set forth above.

What is claimed is:

1. A golf club head of the wood-type, comprising:

a. a metal body having a heel end and a toe end and comprising an upper surface, a lower surface, a front ball striking face, and a curved rear surface extending rearward of the striking face between the upper and lower surface, the curved rear surface having a concave slot formed therein, the slot extending along substantially the entire length of the rear surface, the slot having a first end adjacent to the toe end of the striking face and a second end proximate the heel end of the striking face, the slot having a recess formed therein, the recess having a third end and a fourth end, the fourth end being closer to the heel end of the metal body than the third end, a distance between the first and third ends being greater than a distance between the second and fourth ends, the recess spanning a portion of the length of the slot; and b. a peripheral weight removably secured in the recess of the body in order to increase the moment of inertia of the club head when used to strike a golf ball.

2. The golf club head as defined in claim 1, wherein said peripheral weight has a uniform weight distribution throughout its length.

3. The golf club head as defined in claim 1, wherein the peripheral weight has an arcuate configuration.

4. The golf club head as defined in claim 3, wherein the peripheral weight has a generally C-shaped configuration.

5. The golf club head as defined in claim 1, wherein the peripheral weight is composed of a synthetic plastic material.

6. The golf club head as defined in claim 1, wherein the peripheral weight is composed of a metal material.

7. The golf club head as defined in claim 1, wherein the peripheral weight is secured in the recess of the metal body with at least one fastener.

* * * * *